US006650175B2

(12) United States Patent
Messager

(10) Patent No.: US 6,650,175 B2
(45) Date of Patent: Nov. 18, 2003

(54) DEVICE GENERATING A PRECISE REFERENCE VOLTAGE

(75) Inventor: Philippe Messager, Nantes (FR)

(73) Assignee: Atmel Nantes S.A. (FR)

( * ) Notice: Subject to any disclaimer, the term of this patent is extended or adjusted under 35 U.S.C. 154(b) by 70 days.

(21) Appl. No.: 10/071,605

(22) Filed: Feb. 8, 2002

(65) Prior Publication Data

US 2002/0136065 A1 Sep. 26, 2002

(30) Foreign Application Priority Data

Feb. 9, 2001 (FR) ..... 01 01821

(51) Int. Cl.[7] ..... G05F 1/10

(52) U.S. Cl. ..... 327/541; 327/542; 327/543; 323/316

(58) Field of Search ..... 327/538, 540, 327/541, 542, 543; 323/313, 316

(56) References Cited

U.S. PATENT DOCUMENTS 4,127,783 A * 11/1978 Alaspa ..... 327/538
5,300,823 A * 4/1994 Ihara ..... 327/544
5,721,485 A * 2/1998 Hsu et al. ..... 713/323
6,046,577 A 4/2000 Rincon-Mora et al. ..... 323/282
6,225,857 B1 * 5/2001 Brokaw ..... 327/540

FOREIGN PATENT DOCUMENTS

EP 0 971 280 1/2000

* cited by examiner

*Primary Examiner*—Terry D. Cunningham
(74) *Attorney, Agent, or Firm*—Piper Rudnick

(57) ABSTRACT

A device generating a precise reference voltage. This device comprises a semiconductor circuit (1) of "bandgap" type delivering a reference voltage (Vref) and a multiplier circuit (2) delivering an output voltage ($V_{OUT}$) from the reference voltage. A galvanic link (3) makes it possible to supply the semiconductor circuit (1) from the precise reference voltage, and an initialization circuit (4) makes it possible, on initialization, to replace this precise reference voltage with the build-up voltage of the supply voltage. Application to reference voltage generating circuits of analogue/digital converter circuits in CMOS technology.

4 Claims, 13 Drawing Sheets

"BANDGAP" SEMICONDUCTOR CIRCUIT

DEVICE GENERATING A PRECISE REFERENCE VOLTAGE

FIELD OF INVENTION

The present invention relates to a device generating a precise reference voltage, more especially intended for producing, from an external supply potential which may vary between a minimum value and a maximum value, a precise reference output voltage which is stable regardless of the operating temperature of the generator and the value of the external supply potential.

BACKGROUND OF THE INVENTION

Such generating devices are especially adapted to provide an electronic circuit, such as for example an analogue/digital converter, with a stable reference potential in such a way as to render the operation of this converter more stable and more precise, while also reducing the consumption of these generators.

Among these generating devices, the invention relates more especially to those comprising a semiconductor circuit 1, more commonly designated as "bandgap" circuit, this type of circuit making it possible to develop a reference voltage, hereinbelow designated semiconductor circuit 1, and at least one voltage multiplier circuit 2 arranged in cascade with this semiconductor circuit, this voltage multiplier circuit being intended for providing, from the reference voltage delivered by the semiconductor circuit, the stable reference output voltage. Such a generating device of the prior art is represented in FIG. 1*a*.

Customarily, the semiconductor circuits of this type require, before any use, prior adjustment so that the reference potential delivered by the latter is as stable and precise as possible regardless of any variations in the external supply voltage and in the temperature.

The drawback of this "bandgap" semiconductor circuit 1 resides in the fact that a compromise must routinely be found between the obtaining of temperature precision and the obtaining of supply voltage precision. More precisely, the adjustment of this type of semiconductor circuit can be performed according to three schemes, that is to say:

- either this semiconductor circuit is adjusted in such a way that the reference voltage delivered by it varies only, for example, by a few mV throughout the range of operating temperatures, to the detriment of a variation of, for example, several tens of mV throughout the range of the supply voltage;
- or this semiconductor circuit is adjusted in such a way as to obtain a compromise between the temperature stability, the reference voltage delivered by it and the external supply voltage varying by, for example, about 10 mV voltage-wise and temperature-wise.

Such adjustment results in appreciable imprecision in the reference voltage delivered by this semiconductor circuit 1, this imprecision being, however, passed on through multiplication by the multiplying circuit 2 to the supposedly precise predetermined output voltage, delivered at the output of the voltage generating device.

Specifically, as represented in FIG. 1*a*, the voltage multiplier circuit 2 includes a differential amplifier OPA receiving on its negative terminal the reference voltage Vref as set-point voltage and a resistive feedback circuit $R'_1$, $R'_2$, $R'_3$ with a decoupling capacitor $C_2$ comprising a regulating transistor Tr connected between the supply voltage Vcc and the resistive bridge restoring in part the output voltage $V_{OUT}$, supposedly precise reference voltage, on the positive terminal of the operational amplifier OPA. The gate electrode of the regulating transistor Tr is linked and controlled by the output of the differential amplifier OPA, the junction point between the regulating transistor Tr and the resistive bridge constituting the output terminal delivering the supposedly precise reference voltage. The regulating transistor Tr plays the role of a voltage-controlled resistor and the multiplier circuit 2 makes it possible to slave the output voltage $V_{OUT}$ to a value above the reference voltage Vref, but below the value of the supply voltage Vcc, as a function of the relative values of the resistors $R'_1$, $R'_2$ and $R'_3$, the value of resistance of the regulating transistor Tr being low.

However, the variations in the supply voltage, and in the reference voltage Vref, are amplified as a consequence, thereby impairing the actual precision of the assembly.

Additionally these reference generators exhibit considerable consumption especially when the external supply potential Vcc is at its maximum value.

SUMMARY OF THE INVENTION

The object of the present invention is in particular to remedy these drawbacks by improving the precision and the stability of precise-reference generating devices, independently of their relative adjustment in terms of external supply voltage, respectively in terms of operating temperature, while also benefiting from lower consumption.

Accordingly, the device generating a precise reference voltage, which is the subject of the present invention, comprises a semiconductor circuit generating a reference voltage and a voltage multiplier circuit which are supplied from a supply voltage. The voltage multiplier circuit comprises at least one differential amplifier receiving on its negative terminal this reference voltage as set-point voltage and a resistive feedback circuit comprising a regulating transistor connected between the supply voltage and a resistive bridge restoring, in part, the precise reference voltage on the positive terminal of this differential amplifier. The gate electrode of the regulating transistor is linked and controlled by the output of the differential amplifier and the junction point between the regulating transistor and the resistive bridge constitutes, for this generating device, an output terminal delivering the precise reference voltage.

The device furthermore comprises a galvanic link linking this output terminal delivering this precise reference voltage to the supply input of the semiconductor circuit and an initialization circuit connected to the gate electrode of the regulating transistor and making it possible on initialization, by turning on at the supply voltage of this precise reference voltage generating device, to replace the precise reference voltage with the build-up voltage of the supply voltage. This makes it possible, on the one hand, under transient conditions, on initialization, to supply the semiconductor circuit from the build-up voltage of the supply voltage, and, on the other hand, under steady conditions, to deliver on the output terminal of this generating device the precise reference voltage and to supply the semiconductor circuit from this precise reference voltage.

The initialization circuit includes a circuit generating a control pulse of specified duration, this control pulse applied to the gate electrode of the regulating transistor tripping this regulating transistor into the fully on state, for the duration of initialization. This makes it possible to impose on the output terminal of the device generating a precise reference voltage a voltage equal to said build-up voltage of said supply voltage.

BRIEF DESCRIPTION OF THE DRAWINGS

Other characteristics and advantages of the invention will become apparent in the course of the following description of one of its embodiments, given by way of nonlimiting example, in conjunction with the appended drawings, in which, apart from FIG. 1*a* and FIG. 1*b* which relate to the prior art.

MORE DETAILED DESCRIPTION

Figure 2:
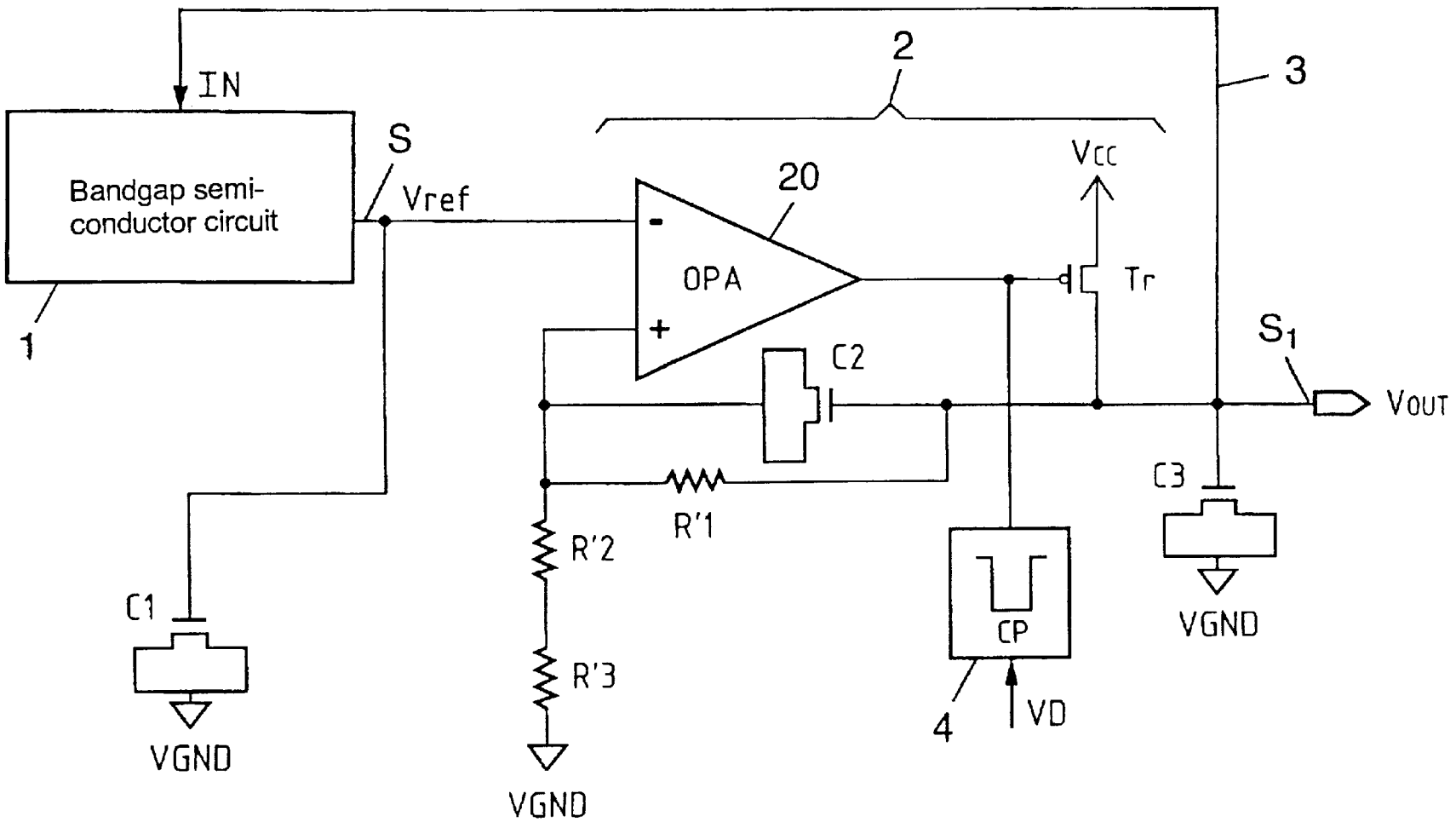
FIG. 2 is a diagram of the device according to the present invention.

With reference to FIG. 2, the device generating a precise reference voltage, according to the present invention, comprises a semiconductor circuit 1, of "bandgap" type which is arranged in cascade with a voltage multiplier circuit 2.

Figure 1A:
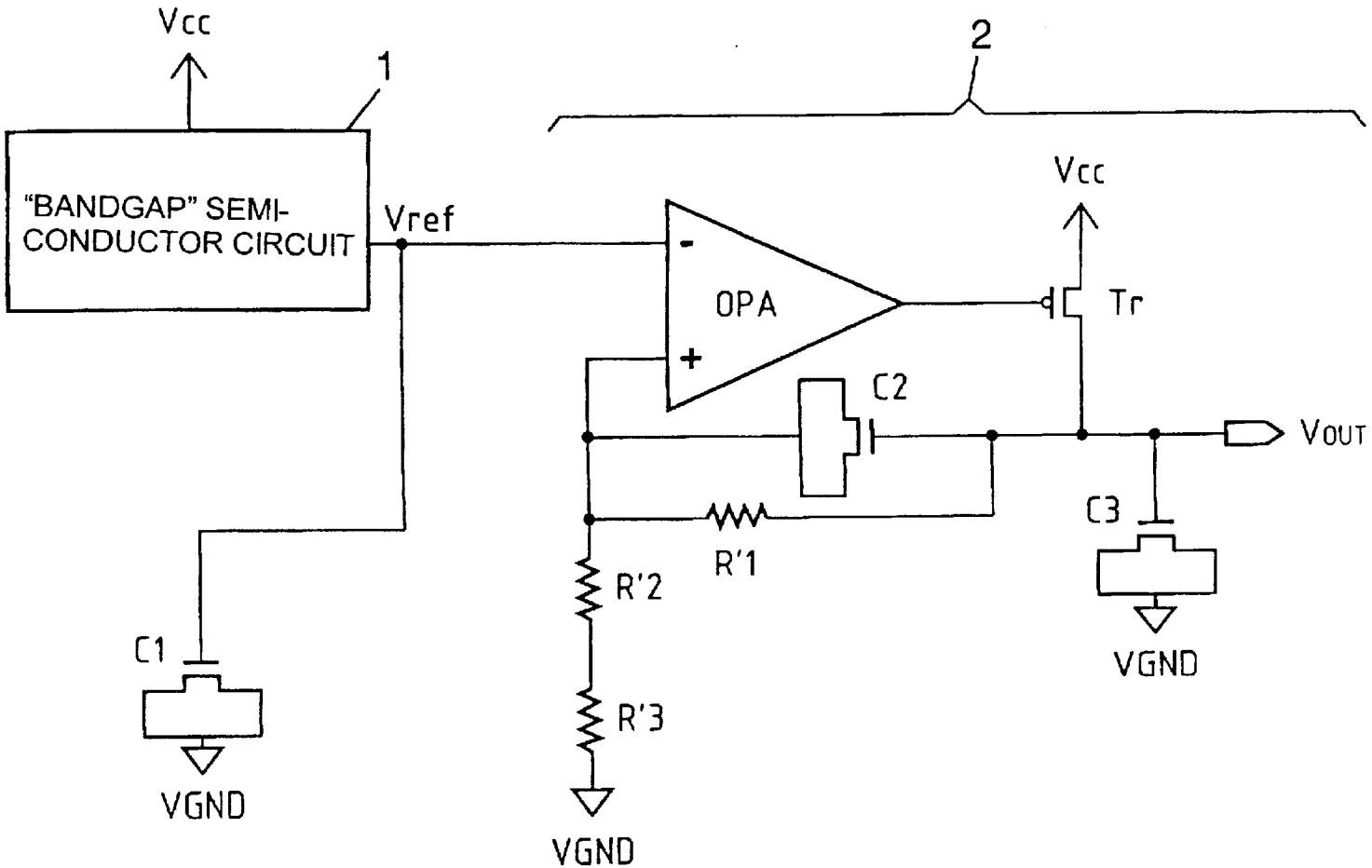
FIG. 1a (Prior art)
Figure 1B:
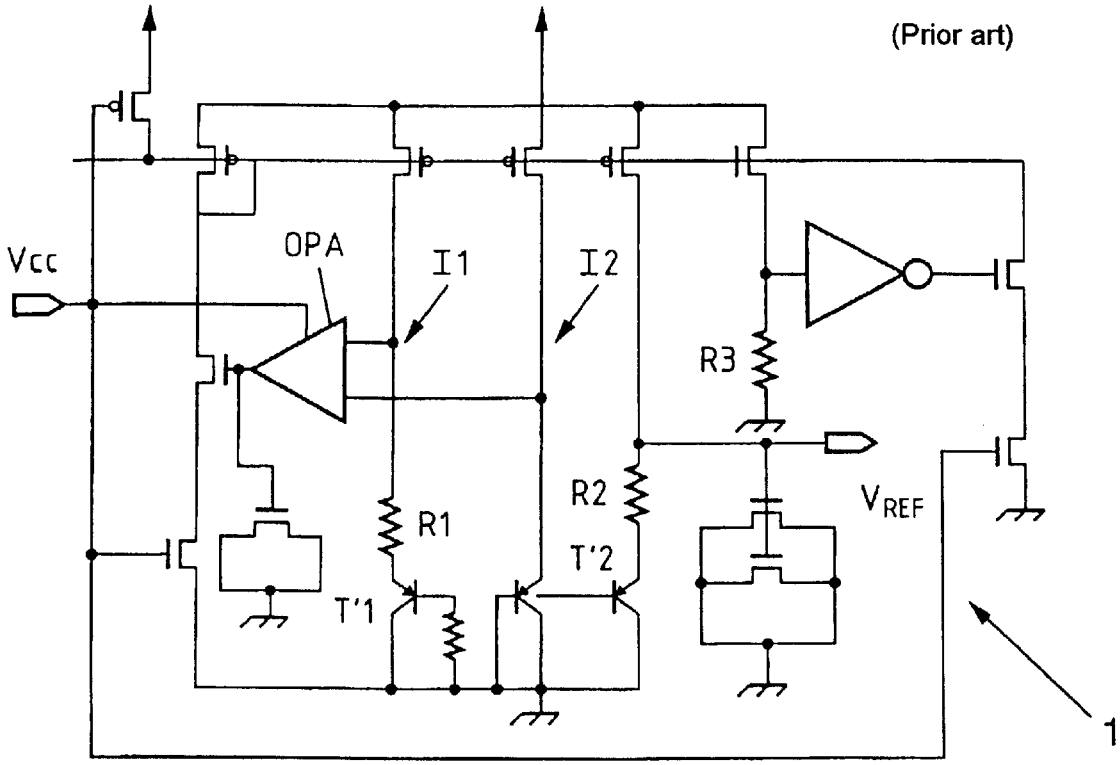
FIG. 1b (Prior art)

The semiconductor circuit 1 consists of a circuit of "bandgap" type such as represented in FIG. 1*b* developing a reference voltage Vref.

An example of such a semiconductor circuit generating a reference voltage is represented diagrammatically in the aforesaid FIG. 1*b* when this circuit is supplied via a supply voltage Vcc. This circuit is embodied in the form of an integrated circuit. It is widely used in the prior art and provides a relatively stable reference voltage Vref. This circuit is known as a "bandgap-type reference voltage source", the word bandgap designating the energy of transition of electrons from the conduction band to the valence band in the semiconductor used. This energy depends, in a known manner, on temperature. The reference sources of this type use the dependence of certain circuit parameters as a function of this energy and hence of temperature, in order to achieve, via appropriate compensations, an approximately stable reference voltage Vref.

The circuit of FIG. 1*b* essentially comprises two bipolar transistors $T_1$, $T_2$ mounted in a diode arrangement, three resistors $R_1$, $R_2$, $R_3$, and an operational amplifier OPA.

The amplifier OPA, which is supplied via the external supply voltage Vcc, comprises an inverting input linked to the collector of the bipolar transistor $T'_2$, and a noninverting input linked to the resistor $R_1$ which is itself linked to the collector of the bipolar transistor $T'_1$. The resistor $R_3$, for its part, allows the build-up of the circuit during a rise in the external supply voltage Vcc. The reference voltage Vref which is stable as a function of temperature and of external supply voltage Vcc, is provided at the output S of the circuit.

The stability of the reference voltage Vref relies in particular on an appropriate choice of the junction areas of the two bipolar transistors $T'_1$, $T'_2$, and of the values of $R_1$ and $R_2$.

$$Vref = V_{be2} + 2 \times \frac{R_2}{R_1} \ln\left(\frac{I_2}{I_1}\right) V_T$$

where $V_{be2}$ and $V_T$ are respectively the base emitter voltage and the threshold voltage of the transistor $T'_2$, and $I_1$ and $I_2$ the currents flowing respectively in the resistors $R_1$ and $R_2$, ln designating the Napierian logarithm.

In the example represented, Vcc can vary between $Vcc_{min}$=2V and $Vcc_{max}$=5.5V, $R_1$=22 k, $R_2$=64.3 k and $R_3$=100 k. The amplitude value of the reference voltage Vref then obtained at the output is of the order 1.25V.

This semiconductor circuit 1 is subjected, in a manner similar to the bandgap-type reference voltage sources of the prior art, to a prior adjustment. In the example represented, the semiconductor circuit 1 is adjusted in such a way that Vref varies by 2 mV temperature-wise and by 30 mV voltage-wise.

Again with reference to FIG. 2, the voltage multiplier circuit 2 comprises a differential amplifier 20, consisting of an operational amplifier $OP_1$ which is arranged as a voltage multiplier, the voltage multiplier 2 operating as a multiplier and as a voltage regulator.

This differential amplifier 20 has a noninverting input + which is linked directly to the output S of the semiconductor circuit 1, an output $S_1$ which delivers a predetermined output voltage $V_{our}$, constituting the sought-after precise reference voltage. This output $S_1$ is linked by a galvanic link 3 to the supply input IN of the semiconductor circuit 1 developing the reference voltage Vref. Thus, the semiconductor circuit 1 is, under steady conditions, supplied via the precise reference voltage, as will be described in greater detail in the description. A capacitor $C_1$ makes it possible to smooth the reference voltage Vref and a capacitor $C_3$ makes it possible to smooth the output voltage $V_{OUT}$.

Furthermore, as may be observed in FIG. 2, a resistive feedback circuit is provided, comprising a regulating transistor Tr connected between the supply voltage Vcc and a resistive bridge $R'_1$, $R'_2$, $R'_3$ restoring, in part, the precise reference voltage, output voltage $V_{OUT}$ delivered by the output terminal $S_1$, on the non-inverting terminal + of the differential amplifier 20, operational amplifier OPA. The gate electrode of the regulating transistor Tr is linked and controlled by the output of the differential amplifier 20. The junction point between the regulating transistor Tr and the resistive bridge constitutes for the precise reference voltage generating device, the output terminal $S_1$ delivering the precise reference voltage $V_{OUT}$.

It is understood in particular that under steady conditions, the differential amplifier 20 slaves the output voltage $V_{OUT}$, precise reference voltage, to a value above the reference voltage value Vref delivered by the semiconductor circuit 1, equilibrium under steady conditions being obtained for:

$$V_{OUT} \times \frac{R'_2 + R'_3}{R'_1 + R'_2 + R'_3} - Vref = 0$$

The reference voltage Vref constitutes a set-point value. The regulating transistor Tr plays the role of an adjustable resistor voltage-controlled by the output of the differential amplifier 20. A decoupling capacitor $C_2$ makes it possible to ensure the stability of the slaving through the introduction of a suitable phase margin under transient conditions.

Finally, an initialization circuit: 4 is connected to the gate electrode of the regulating transistor Tr. This circuit 4 makes it possible under transient conditions, on initialization, when switching on the supply voltage Vcc of the precise reference generating device, which is the subject of the present invention, to replace the precise reference voltage Vref, not yet built up by the semiconductor circuit 1 of "bandgap" type, this type of circuit exhibiting an appreciable supply voltage operating threshold, with the build-up voltage of the supply voltage Vcc.

Such a mode of operating makes it possible, on the one hand, under transient conditions, on initialization, to supply the semiconductor circuit 1 from the build-up voltage of the supply voltage Vcc, and, on account of the increasing nature of this supply voltage, to bring about, according to a cumulative phenomenon, the correlative rise in the output voltage $V_{OUT}$ delivered by the output terminal $S_1$ and hence that of the supply voltage of the semiconductor circuit 1 on account of the presence of the galvanic link 3. This operating mode makes it possible, on the other hand, under steady conditions, to deliver on the output terminal $S_1$, the sought-after precise reference voltage, the reference voltage Vref having reached its nominal value, and to supply the semiconductor circuit 1 from the nominal value of the reference voltage Vref.

In the example represented in FIG. 2, Vref=1.25V, R'1=0.955 MΩ, R'2=0.16 MΩ and R'3=0.95 MΩ. Consequently, $V_{OUT}$=2.32V.

The differential amplifier 20, which is thus arranged in cascade with the semiconductor circuit 1 generating the reference voltage Vref and which, therefore, receives the reference voltage Vref as set-point voltage, makes it possible to deliver a regulated output voltage $V_{OUT}$ constituting the sought-after precise reference voltage regardless of the temperature of operation and the external supply voltage Vcc. It is appreciated in particular that, fine temperature adjustment of the semiconductor circuit 1 can be chosen preferentially, since the voltage regulation as a function of supply voltage is ensured moreover by the voltage regulator and multiplier circuit 2.

The series arrangement of the semiconductor circuit 1 and of the voltage multiplier circuit 2 makes it possible to embody a precise reference voltage generating device which is especially adapted for being associated with a load, such as an electronic circuit, of digital or analogue type, requiring a very stable voltage reference for a comparison of analogue/digital conversion ADC for example and effective stability of operation. Such is the case, for example, for analogue/digital converters.

The benefit of such an arrangement resides in fact in the looping back, via the galvanic link 3, of the voltage multiplier circuit 2 to the supply input of the semiconductor circuit 1 generating the reference voltage Vref which advantageously makes it possible to substantially reduce the adjustment of the voltage precision thereof but to increase the precision of the temperature adjustment span. It is possible to obtain high precision of the reference voltage Vref of the semiconductor circuit 1 and hence of the output voltage $V_{OUT}$. Specifically, when the semiconductor circuit 1 generating the reference voltage Vref and the multiplier circuit 2 have each reached their stable state, under steady conditions, the regulating transistor Tr is adjusted in such a way that the output voltage $V_{OUT}$ is reinjected onto the supply input IN of the semiconductor circuit 1, the latter then being supplied from the stable supply voltage constituted by the precise reference voltage.

Various specific embodiments of the initialization circuit 4 will now be described.

In a first simplified embodiment, the initialization circuit 4 can be formed by a generator of a control pulse of specified duration. In these circumstances, the control pulse CP applied to the gate electrode of the regulating transistor Tr makes it possible to bring this transistor to the fully on state for the duration of initialization and to impose, thus, on the output terminal $S_1$ of the precise voltage generating device which is the subject of the present invention, and on the supply terminal of the semiconductor circuit 1 generating the reference voltage Vref, a voltage substantially equal to the build-up voltage of the supply voltage.

In a nonlimiting mode of execution, the generator 4 can consist of a circuit of monostable type with duration adjustable from a control voltage VD. The adjusting of the duration of the control pulse CP can be performed experimentally for a group of given circuits. The generator 4 is of course supplied via the supply voltage Vcc, which builds up faster than the reference voltage Vref delivered by the semiconductor circuit 1

In a second preferred embodiment, the circuit 4 generating a control pulse of specified duration consists of a circuit of bistable type, synchronized with a start instant and with an end instant of the duration of initialization. In this situation, the duration of initialization is defined by the start, respectively the end of the build-up of the reference voltage Vref delivered by the semiconductor circuit 1.

Figure 3:
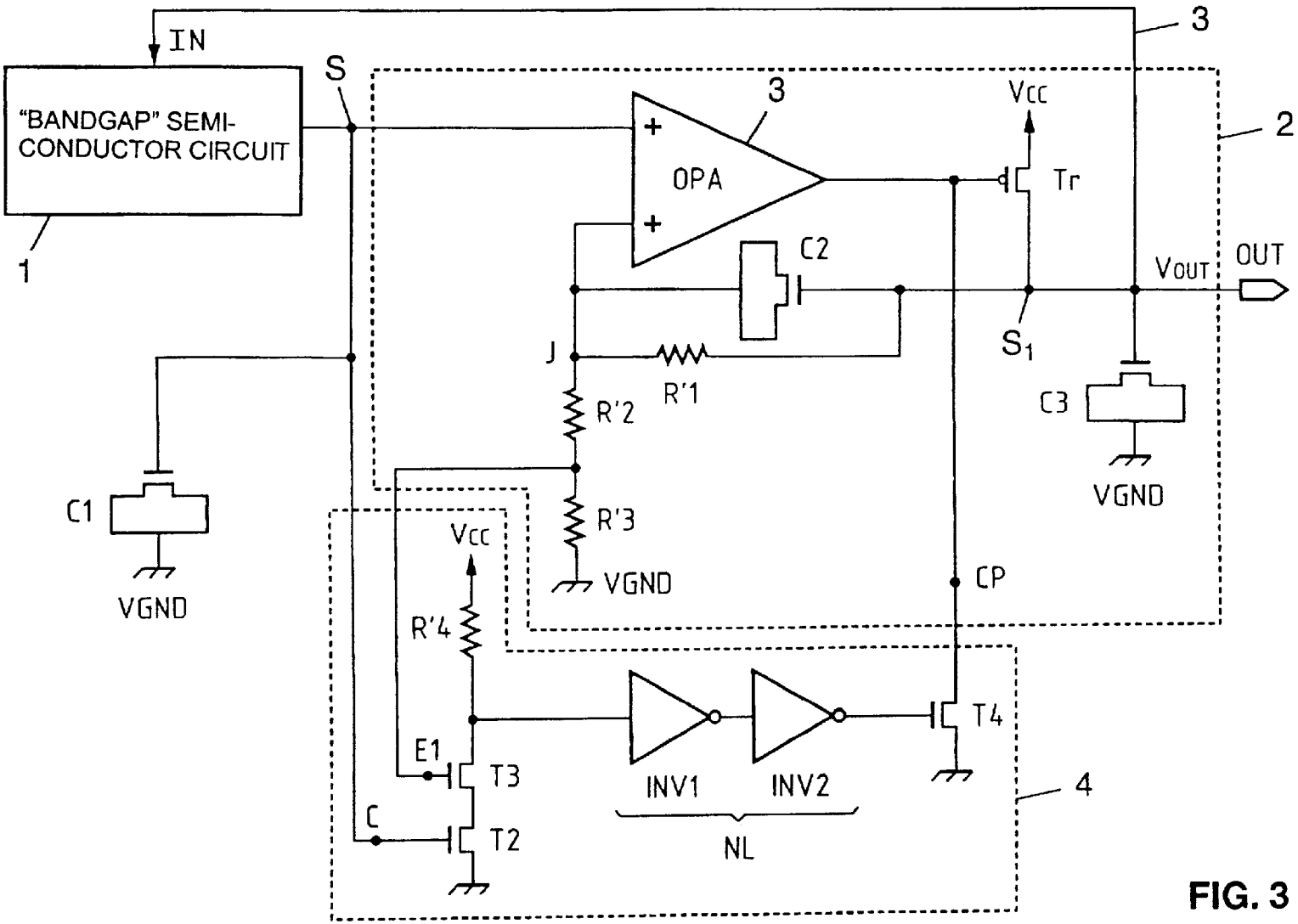
FIG. 3 represents a preferred embodiment of the device generating a precise reference voltage, which is the subject of the present invention.

A specific mode of execution of the preferred embodiment of the initialization circuit 4 is represented in FIG. 3.

In the aforesaid figure, the same references represent the same elements as in the framework of FIG. 2.

With reference to FIG. 3, the synchronized circuit of bistable type includes a first and a second circuit for detecting the simultaneous presence of a build-up voltage of the reference voltage Vref, delivered by the semiconductor circuit 1, respectively of the precise reference voltage $V_{OUT}$ present on the output terminal $S_1$. The first and the second detection circuit are each formed by an N-MOS transistor $T_2$, $T_3$ connected in cascade by way of a resistor $R'_4$ between the supply voltage Vcc and the earth voltage $V_{GND}$. The gate of the transistor $T_2$, first detection circuit, is connected at the output S of the semiconductor circuit 1 so as to detect the presence of the build-up voltage of the reference voltage Vref. The gate of the transistor $T_3$, second detection circuit, is connected to a point representative of the output voltage $V_{OUT}$ so as to detect the presence of the build-up voltage of the precise reference voltage. This representative point can, for example, consist of the point of linking of the resistive bridge, the junction point between $R'_2$ and $R'_3$ for example.

Furthermore, a non-linear switching circuit NL is provided. This circuit is formed by two cascaded inverters $INV_1$ and $INV_2$. The non-linear circuit controls an initialization control transistor $TN_4$, which is connected between the gate of the regulating transistor Tr and the reference voltage $V_{GND}$. A gate electrode of the initialization control transistor is connected directly at the output of the second inverter $INV_2$ forming the non-linear circuit NL. The non-linear switching circuit NL receives as input the voltage detected by the first and the second detection circuit $T_2$, $T_3$, and makes it possible to compare this detected voltage representative of a reference voltage, respectively of a precise reference voltage below a threshold value. This threshold value is representative of the duration of initialization. On this comparison, the non-linear switching circuit NL delivers a first control voltage while the voltage detected is above the threshold value and a second control voltage otherwise, to the initialization control transistor $T_4$ which delivers in switching mode the control pulse CP to the regulating transistor Tr.

The assembly then operates in the following manner:

- the initialization circuit 4 operates only for $0 \leqq Vcc \leqq 2V$, that is to say before the semiconductor circuit 1 operates and before it delivers the reference voltage Vref.
- The output voltage $V_{OUT}$ constituting the precise reference voltage, is equal to Vcc while the voltage delivered by the non-linear switching circuit NL to the gate of the initialization control transistor $TN_4$ is at a high level, the transistor being fully on and imposing $V_{OUT}$= VCC (build-up).

The device generating a precise voltage according to the present invention operates in the following manner.

Upon switching on, the semiconductor 1 generating the reference voltage Vref delivers at output a first potential close to 0V, Vref<1V, and the differential amplifier 20 delivers at output a first output potential close to 0V, $V_{OUT}$<2V, and the transistors $T_2$ and $T_3$ are then turned off. The input of the inverter $INV_1$ then receives a voltage of value equal to VCC which is provided on the source of the transistor $T_3$ by $R'_4$. This voltage is transmitted by way of the two inverters $INV_1$ and $INV_2$ constituting the non-linear switching circuit NL to the gate of the transistor $T_4$ which turns on. The gate of the regulating transistor TR is then biased by the drain/source voltage of the transistor 4, which exhibits a low level, the regulating transistor TR coming on in turn. Owing to the fact that this drain/source voltage exhibits a low level and that the value of the drain/source voltage of the regulating transistor Tr is equal to around 0V, $V_{drain}=V_{source}$=Vcc, the supply input IN of the semiconductor circuit 1 is subjected to the build-up voltage of the supply voltage Vcc by the galvanic link 3.

When the semiconductor circuit 1 generating the reference voltage delivers at output a reference voltage having reached Vref=1.2V which represents its minimum operational reference potential, and when the differential amplifier 20 delivers at output an output voltage $V_{OUT}$>2V, the corresponding gates of the transistors $T_2$ and $T_3$ are respectively biased by Vref and $V_{OUT}$, these transistors then turning on. The input of the inverter $INV_1$ then receives a voltage of zero value which is provided on the source of the transistor $T_3$. This voltage is transmitted by way of the non-linear switching circuit NL to the gate of the transistor $T_4$ which turns off. The gate of the regulating transistor TR is then biased by the output voltage $V_{S1}$ delivered by the differential amplifier 20, and the regulating transistor Tr then behaves as a resistor which follows the profile of $V_{S1}$. The output voltage constituting the precise reference voltage is now delivered to the supply input IN of the semiconductor circuit 1.

When, under steady conditions, the operation of the semiconductor circuit 1 generating the reference voltage and of the differential amplifier 20 has stabilized, that is to say that, in the example represented, Vref=1.25V and $V_{OUT}$=2.4V, the supply input IN of the semiconductor circuit 1, which input is linked to the output $S_1$ and to the drain of the transistor $T_1$, is subjected permanently to the precise reference voltage at $V_{OUT}$=2.4V, independently of the variations of Vcc. This mode of operation involves a sharp reduction in the consumption of current by the device generating a precise reference voltage, which is the subject of the present invention, with respect to that of the corresponding devices of the prior art.

Moreover, in a particularly noteworthy manner, owing to the fact that the device according to the invention operates under closed-loop regulation, the semiconductor circuit 1 generating the reference voltage is intrinsically stable and precise in terms of voltage, without it being necessary to undertake a specific voltage adjustment, thereby making it possible to choose a precise adjustment in terms of temperature, rather than in terms of voltage. Measurements have shown that the voltage precision of the semiconductor circuit 1 generating the reference voltage was of the order of 2 mV. Such precision and such stability are advantageously passed onto the output voltage $V_{OUT}$ delivered at the output OUT and constituting the precise reference voltage within the meaning of the present invention.

Figure 4A:
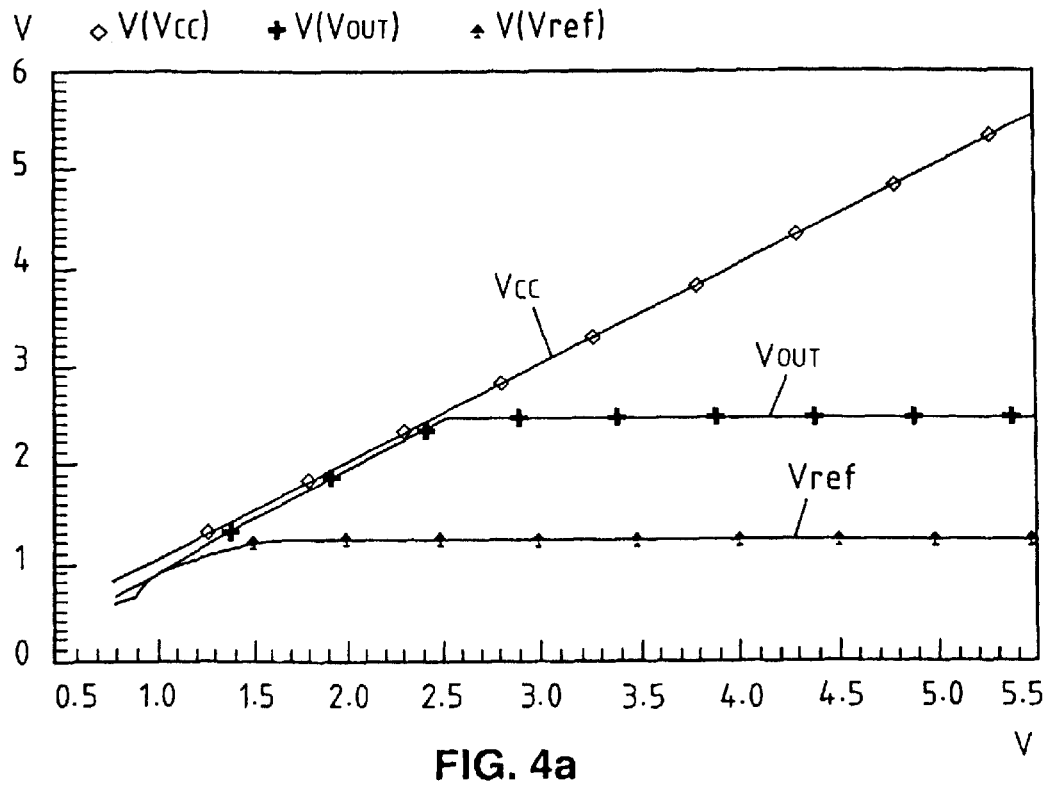
FIGS. 4*a* to 4*j* represent the profile of the voltages at significant test points of the device according to the present invention.
Figure 4B:
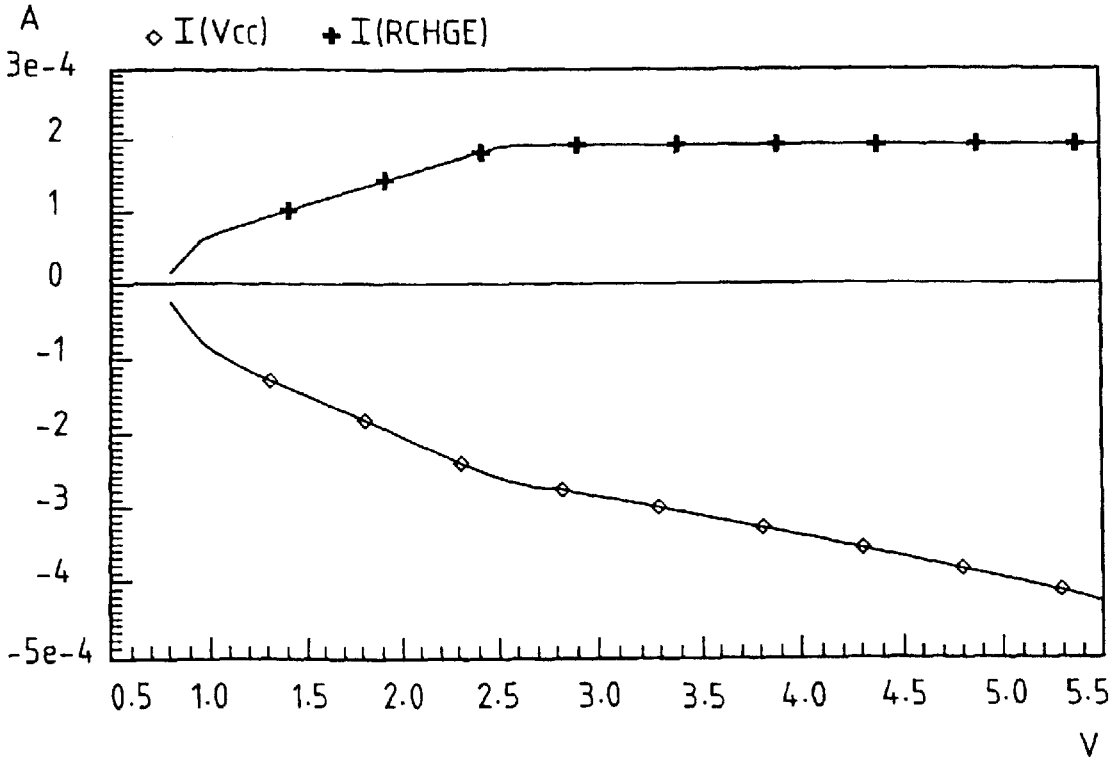
Figure 4C:
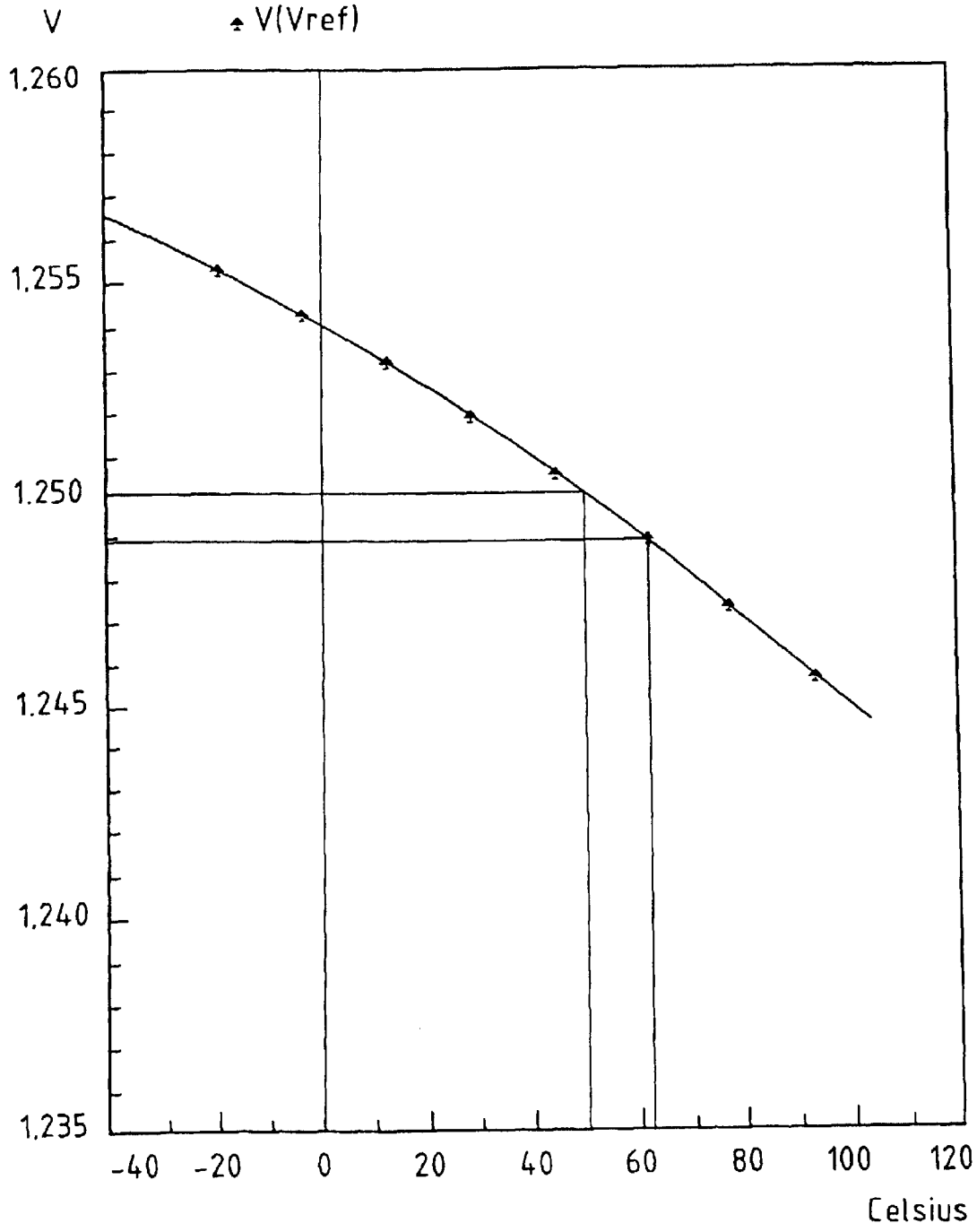
Figure 4D:
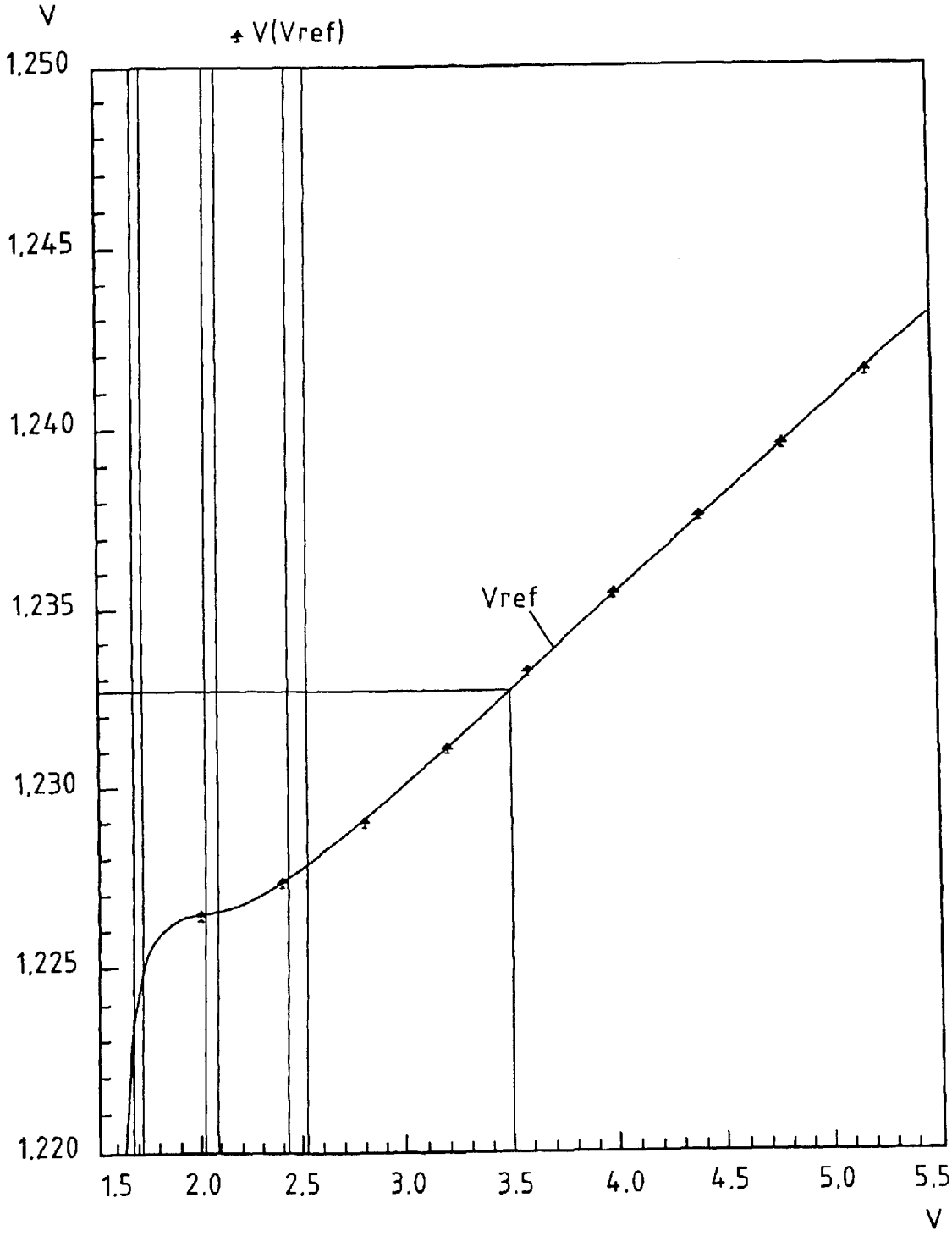
Figure 4E:
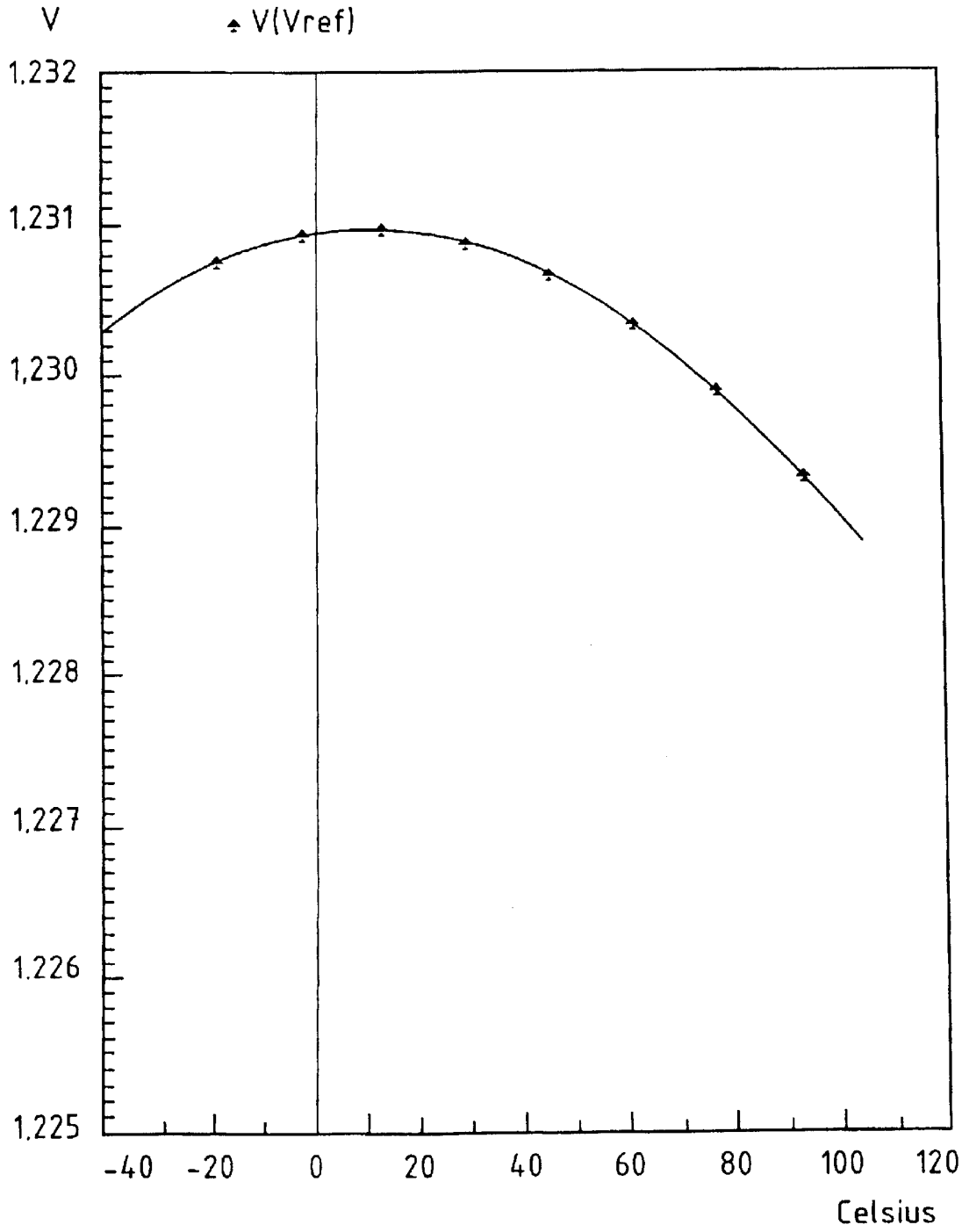
Figure 4F:
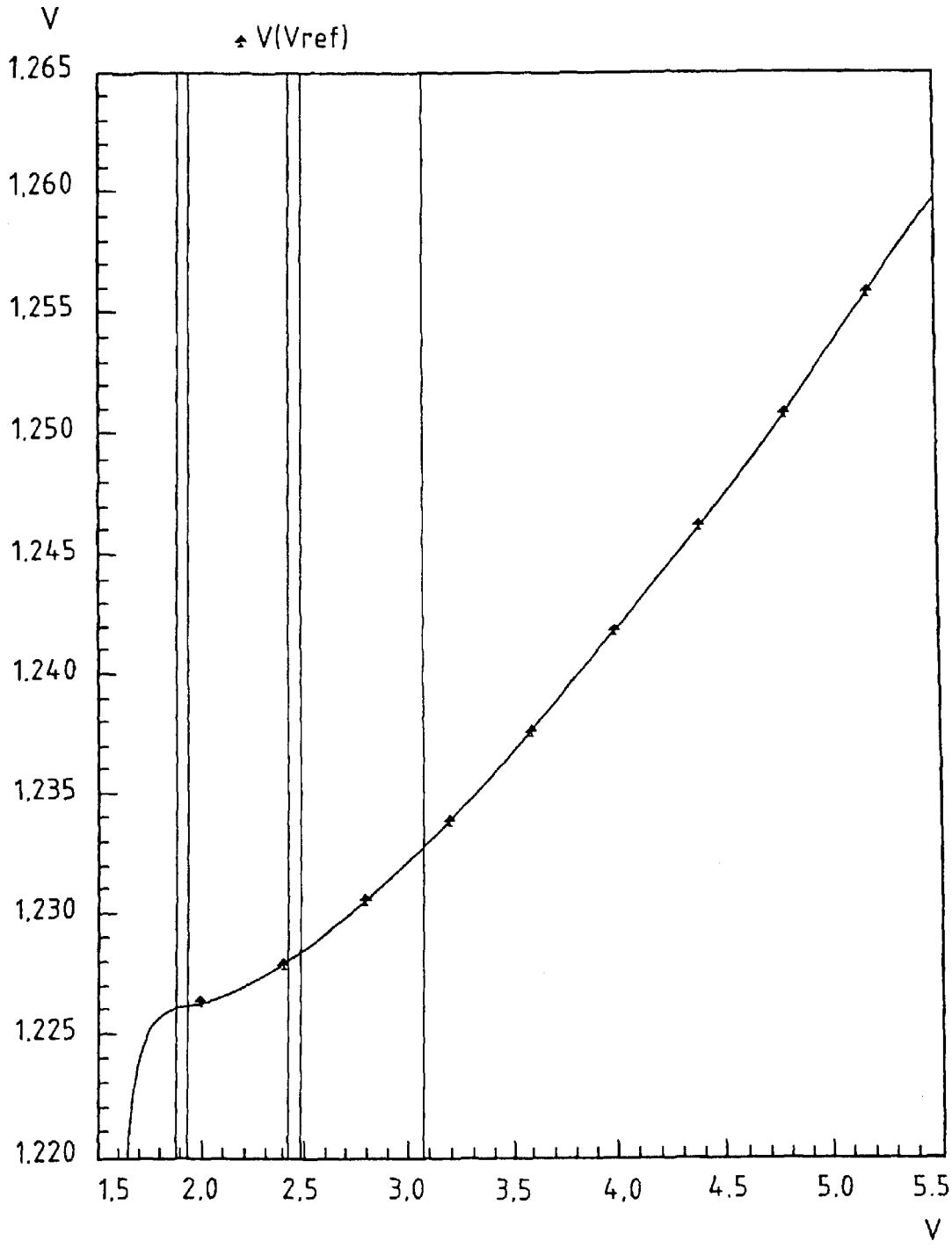

For a semiconductor circuit 1:

FIGS. 4*a* and 4*b* represent the values of the output voltage $V_{OUT}$ and of the reference voltage Vref as a function of the external supply voltage Vcc, respectively the values of the magnitude of the current delivered by the supply voltage Vcc and by the output terminal $S_1$ to a given load, the ordinate axis being graduated in hundreds of micro-amperes;

FIGS. 4*c* and 4*d* represent the variations in the reference voltage Vref delivered at the output S as a function of the temperature, respectively of the supply voltage Vcc, for mixed adjustment;

FIGS. 4*e* and 4*f* represent the variations in the reference voltage Vref delivered at the output S as a function of the temperature, respectively of the voltage of the semiconductor circuit 1 adjusted only temperature-wise, FIG. 4*f* showing a strong variation in supply voltage.

Figure 4G:
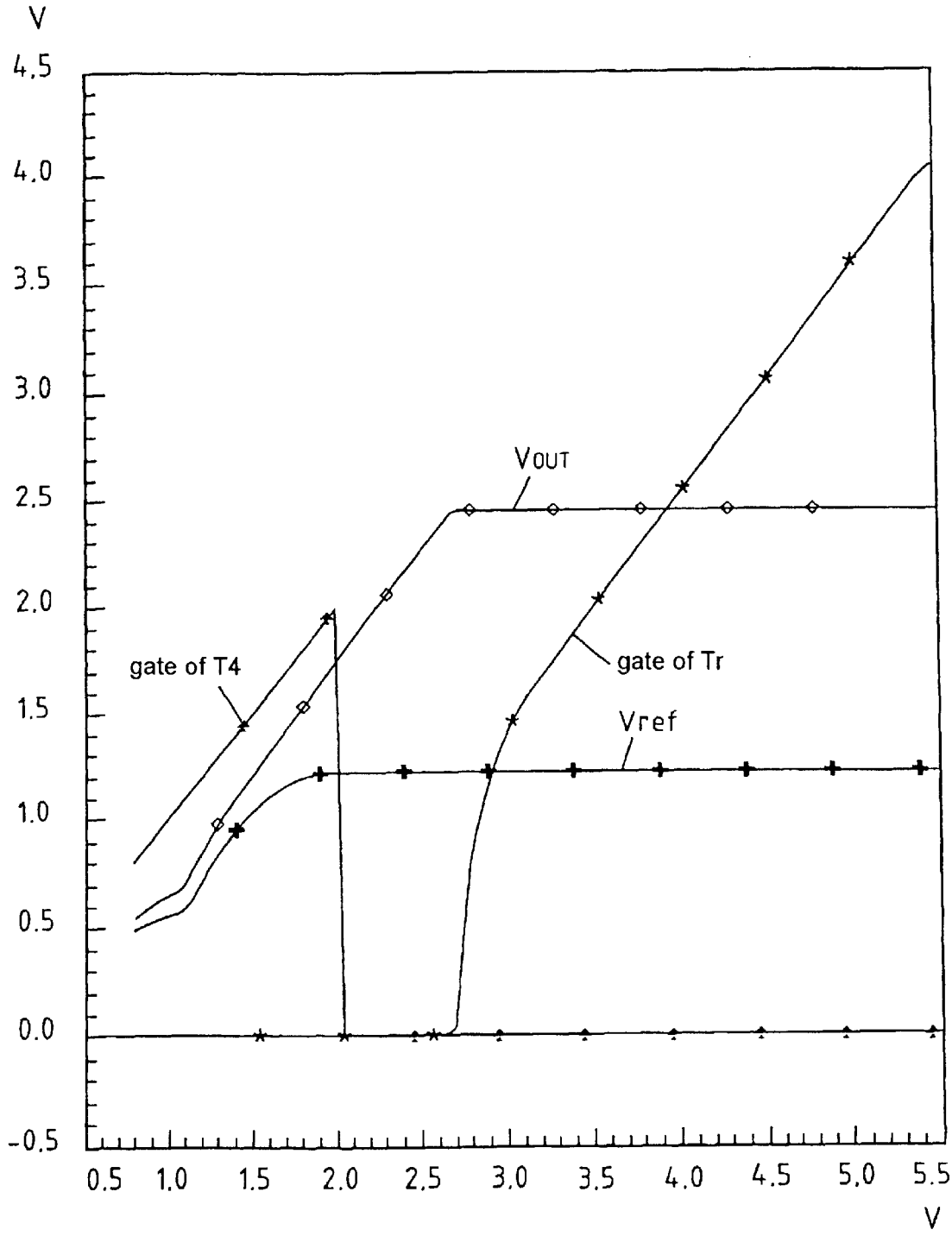
Figure 4H:
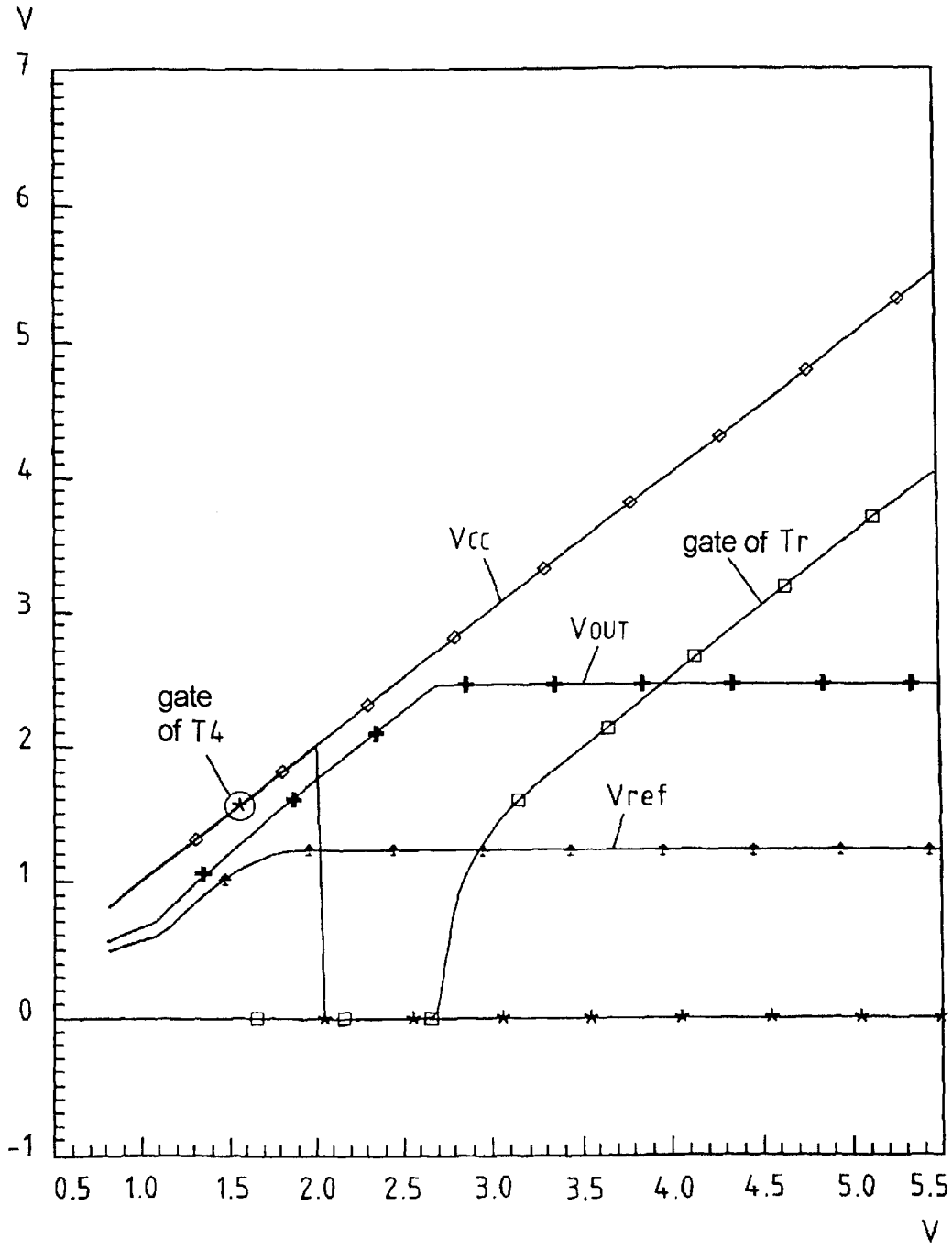
Figure 4I:
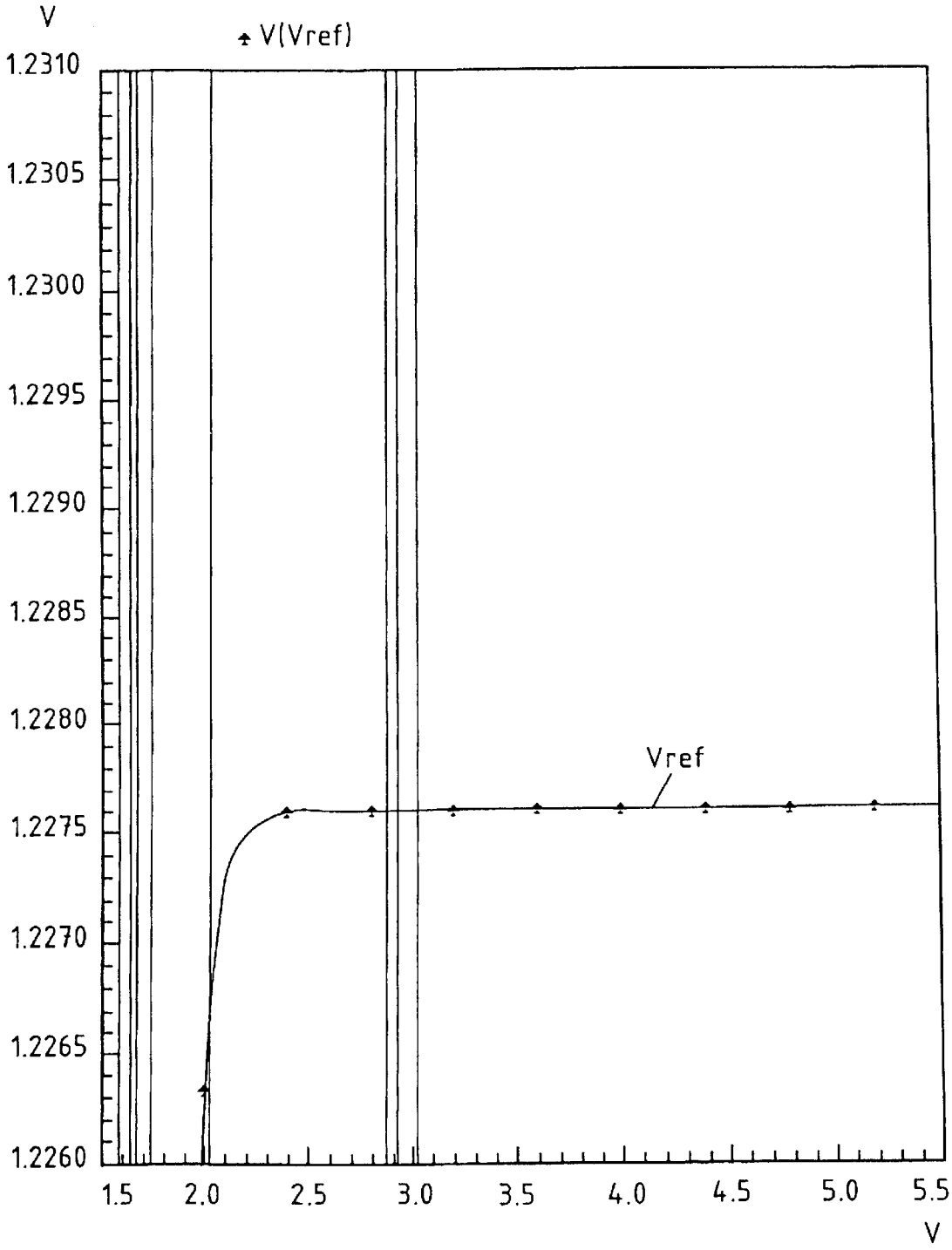
Figure 4J:
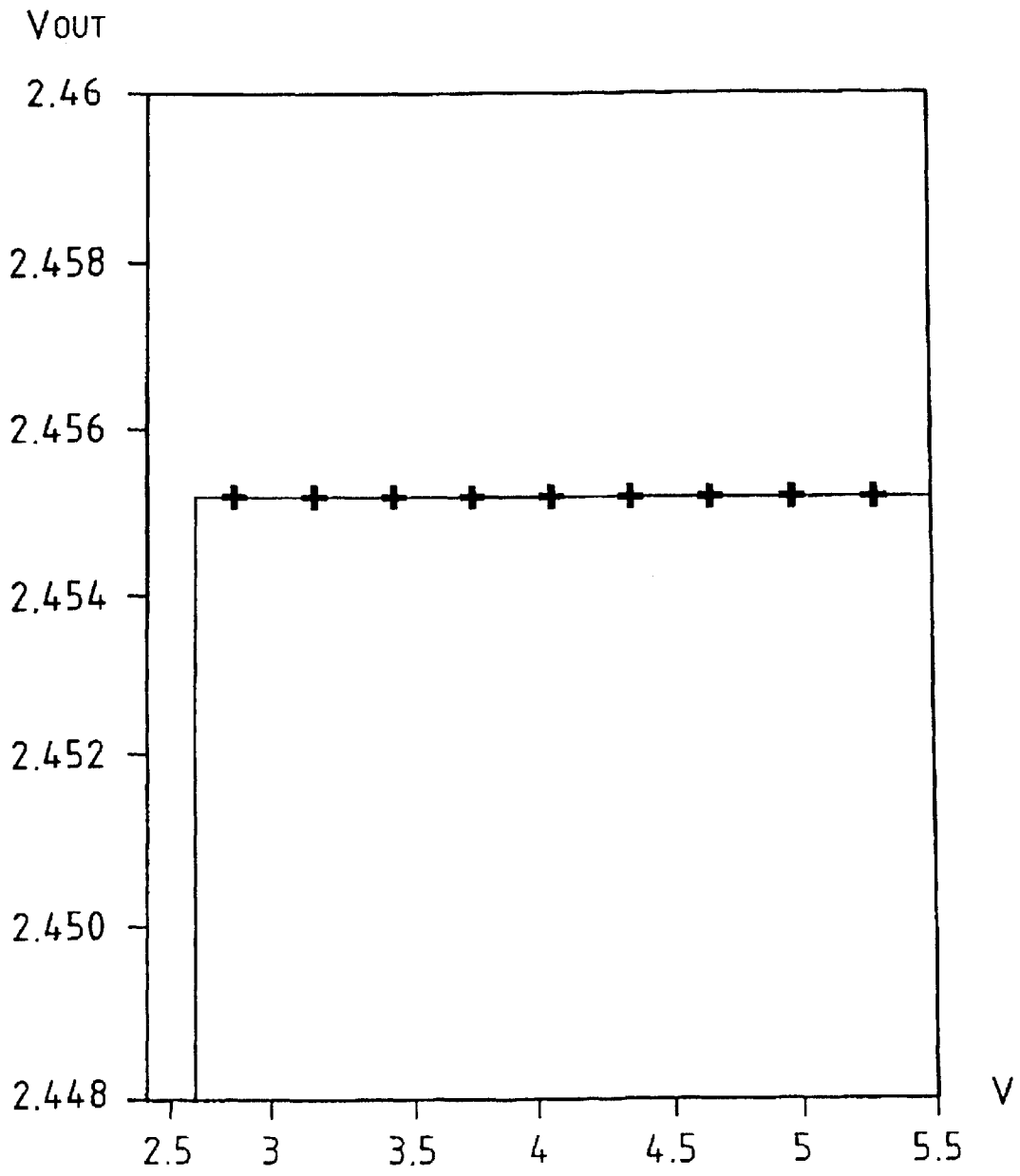

For the device which is the subject of the invention and represented in FIG. 3:

FIGS. 4*g* and 4*h* represent, on different voltage value scales, the variations in the output voltage $V_{OUT}$, in the reference voltage Vref and in the voltage applied to the gate of the regulating transistor Tr when, with reference to FIGS. 4*e* and 4*f*, the semiconductor circuit is adjusted only temperature-wise;

FIGS. 4*i* and 4*j* represent, on different voltage value scales, the reference voltage Vref delivered by the semiconductor circuit 1, respectively the output voltage $V_{OUT}$, the precise reference voltage delivered on the terminal $S_1$ as a function of the value of the supply voltage Vcc.

What is claimed is:

1. Device generating a precise reference voltage comprising a semiconductor circuit generating a reference voltage and a voltage multiplier circuit which are supplied from a supply voltage, said voltage multiplier circuit comprising at least one differential amplifier receiving on its negative terminal said reference voltage as set-point voltage and a resistive feedback circuit comprising a regulating transistor connected between said supply voltage and a resistive bridge restoring, in part, the precise reference voltage on the positive terminal of said differential amplifier, the gate electrode of said regulating transistor being linked and controlled by the output of said differential amplifier and the junction point between said regulating transistor and said resistive bridge constituting for this generating device an output terminal delivering said precise reference voltage, wherein said device furthermore comprises:

a galvanic link linking said output terminal delivering said precise reference voltage to the supply input of said semiconductor circuit;

an initialization circuit connected to the gate electrode of said regulating transistor and making it possible, under transient conditions, on initialization, by turning on at the supply voltage of said precise reference voltage generating device, to replace said precise reference voltage with the build-up voltage of said supply voltage, thereby making it possible, on the one hand, under transient conditions, on initialization, to supply said semiconductor circuit from the build-up voltage of said supply voltage, and, on the other hand, under steady conditions, to deliver on said output terminal of said generating device said precise reference voltage and to supply said semiconductor circuit from this precise reference voltage.

2. Device according to claim 1, wherein said initialization circuit includes a circuit generating a control pulse of specified duration, said control pulse applied to the gate electrode of said regulating transistor tripping said regulating transistor into the fully on state, for the duration of initialization, thereby making it possible to impose on the output terminal of said device a voltage equal to said build-up voltage of said supply voltage.

3. Device according to claim 2, wherein said circuit generating a control pulse of specified duration consists of a circuit of bistable type, synchronized with the start instant and with the end instant of said duration of initialization defined by the start respectively the end of the build-up of said reference voltage delivered by said semiconductor circuit.

4. Device according to claim 3, wherein said synchronized circuit of bistable type comprises:

a first and a second circuit for detecting the simultaneous presence of a build-up voltage of the reference voltage, respectively of the precise reference voltage on the output terminal, these first and second detection circuits being connected in cascade and making it possible to develop a detected voltage representative of a reference voltage, respectively of a precise reference voltage, below a threshold value representative of said duration of the initialization period;

a non-linear switching circuit receiving as input said detected voltage and making it possible to compare this detected voltage with said threshold value, said non-linear circuit delivering a first control voltage while said detected voltage is above said threshold value and a second control voltage otherwise;

an initialization control transistor whose gate electrode connected at the output of said non-linear circuit is controlled in switching mode by the first, respectively the second control voltage delivered by said non-linear switching circuit, said initialization control transistor being connected in parallel between the gate electrode of said regulating transistor and the earth voltage of said device, thereby making it possible to turn on said initialization control transistor when said non-linear switching circuit delivers the first control voltage, the output terminal of the device delivering, for the duration of initialization, the build-up voltage of said supply voltage by way of said regulating transistor, rendered fully on, respectively the turning off of said initialization control transistor when said non-linear switching circuit delivers the second control voltage, the output terminal of said device delivering said precise reference voltage by way of said regulating transistor, playing the role of a voltage-controlled resistor tripped by the output of said differential amplifier.

* * * * *